United States Patent [19]

Takase et al.

[11] 4,073,131

[45] Feb. 14, 1978

[54] TIME-SETTING AND DISPLAYING MODE CONTROL CIRCUIT FOR AN ELECTRONIC TIMEPIECE

[75] Inventors: Tuneo Takase; Tetsuo Yamaguchi, both of Yokohama, Japan

[73] Assignee: Tokyo Shibaura Electric Co., Ltd., Kawasaki, Japan

[21] Appl. No.: 679,971

[22] Filed: Apr. 26, 1976

[30] Foreign Application Priority Data

Apr. 28, 1975 Japan ..... 50-50793

[51] Int. Cl.[2] ..... G04B 27/08; G04C 3/00

[52] U.S. Cl. ..... 58/23 R; 58/85.5; 307/247 A

[58] Field of Search ..... 58/23 R, 50 R, 85.5; 307/247 A

[56] References Cited

U.S. PATENT DOCUMENTS 3,988,886 11/1976 Kashio ..... 58/23 R

*Primary Examiner*—Stanley J. Witkowski

*Attorney, Agent, or Firm*—Oblon, Fisher, Spivak, McClelland & Maier

[57] ABSTRACT

There is provided a time setting and displaying mode control circuit for an electronic timepiece comprising first and second switches, first and second detection circuits responsive to the operative conditions of the respective first and second switches and first and second ring counters each including a plurality of shift registers and respectively connected to the first and second detection circuits to produce time setting and displaying mode signals, respectively.

The content of the first ring counter is shifted in response to an output signal produced from the first detection circuit each time the first switch is depressed in the time setting mode. The content of the second ring counter is shifted in response to an output signal produced from the second detection circuit each time the second switch is depressed in the time displaying mode. When the first switch is depressed under the "hour-minute" displaying mode, the content of the first ring counter is changed to provide the "hour" setting mode. Further, when the first switch is kept depressed for more than two seconds in the time setting mode, all the shift registers of the first ring counter are reset to permit the second shift register to provide the "hour-minute" displaying mode.

13 Claims, 4 Drawing Figures

TIME-SETTING AND DISPLAYING MODE CONTROL CIRCUIT FOR AN ELECTRONIC TIMEPIECE

This invention relates to a time-setting and displaying mode control circuit for an electronic timepice.

Recently, with a development of large-scale integrated circuits (LSI) an electronic digital timepiece gets into the spotlight in replacement of a mechanical timepiece. This type of electronic digital timepiece, however, has a problem that time correction is not easy. Generally, a display circuit is initially reset and then a desired time-setting mode is selected from time-setting modes including a "month", "date", "day of the week", "hour", "minute" or "second"-setting mode and thereafter time correction is performed. In this case, a time-displaying mode selecting switch, a time-setting mode selecting switch, and a digit carry switch are required for time correction. In the case of selecting a desired time-setting mode, it is necessary to depress the switch a specified number of times and simultaneously for a user to memorize how many times the switch should be depressed with respect to each time-setting mode. In this way, in the prior art, time correction is considerably difficult, in which the user has great inconvenience.

Accordingly, the object of the invention is to provide a time-setting and displaying mode control circuit for an electronic timepiece capable of being subject to easy and quick mode control by operating two switches.

According to an embodiment of the invention, there is provided a time-setting and displaying mode control circuit for an electronic timepiece comprising a first and a second switch, a first-switch operative condition detecting circuit for generating a signal upon operation of the first switch, a second-switch operative condition detecting circuit for generating a signal upon operation of the second switch, a first ring counter having a first shift register circuit composed of cascade connected shift registers and a first logic circuit whose input terminals are connected to output terminals of the shift registers, respectively, and whose output terminal is connected to the input terminal of the first stage shift register of the first shift register circuit, and adapted to generate a signal corresponding to one of time-setting modes from output terminals of the shift registers of the first shift register circuit, a second ring counter including a second shift register circuit having at least one shift register, a second logic circuit having input terminals connected to the output terminal of the first logic circuit, an input terminal of the second shift register circuit, and an output terminal of said at least one shift register of the second shift register circuit, and controlled by an output signal from the first logic circuit to generate a signal corresponding to one of time-displaying modes, a first mode control circuit connected to the first-switch operative condition detecting circuit and adapted to shift, upon operation of the first switch under a timesetting mode, the content of the first ring counter and to change-over, upon operation of the first switch under a time-displaying mode, said time-displaying mode to a specified time-setting mode by setting a specified shift register of the first shift register circuit, and a second mode control circuit connected to the second-switch operative condition detecting circuit and the first logic circuit and adapted to generate an output signal to shift the content of the second ring counter, each time the second switch is operated during a time-displaying mode period.

This invention can be more fully understood from the following detailed description when taken in conjunction with the accompanying drawings, in which.

Figure 1:
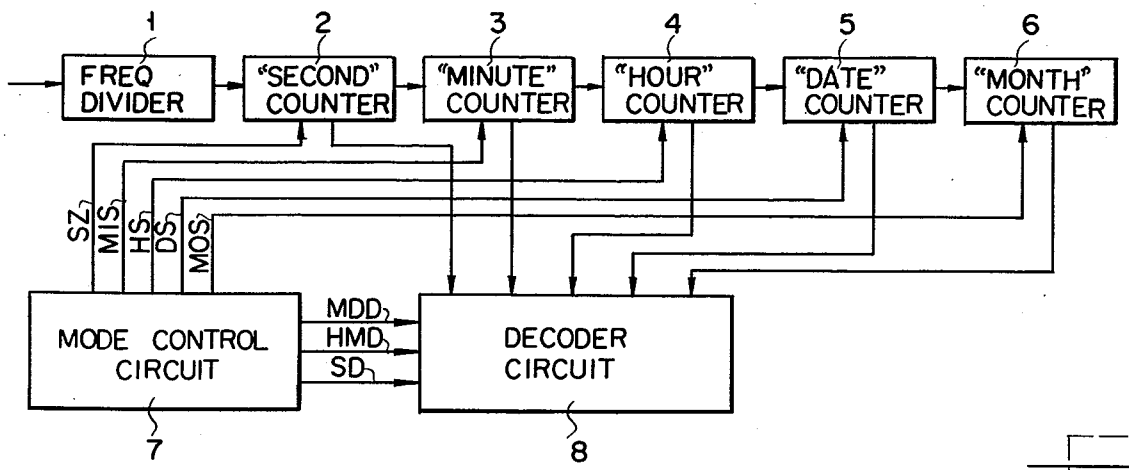
FIG. 1 is a block diagram showing the connection relationship between a time-setting and displaying mode control circuit for an electronic timepiece according to an embodiment of the invention and the remaining circuits of the electronic timepiece.

In FIG. 1, a frequency divider 1, a "second" counter 2, a "minute" counter 3, an "hour" counter 4, a "date" counter 5, and a "month" counter 6 are cascade connected, and the frequency divider 1 divides the frequency of a high frequency pulse from an oscillating circuit (not shown) of an electronic timepiece such as a crystal oscillator circuit to generate a pulse of 1 Hz. This 1 Hz pulse is sent to the counters 2, 3, 4, 5 and 6 in the sequential order mentioned. The counted content of the counters 2 to 6 is supplied to a decoder circuit 8. The decoder circuit 8 receives, in accordance with a "month-date" display mode signal MDD, and "hour-minute" display mode signal HMD, or a "second" display mode signal SD from a mode control circuit 7, "month-date" display signals from the counters 6 and 5, "hour-minute" display signals from the counters 4 and 3, or a "second" display signal from the counter 2, respectively, to generate a decoded signal corresponding to the signal received. In the case of effecting time correction, the mode control circuit 7 supplies a time-setting mode signal SZ, MIS, HS, DS or MOS to a specified one of the counters 2 to 6 thereby to set only this specified counter to a time-correction state. The mode control circuit 7 has a pair of switches SW1 and SW2 (FIGS. 2A and 2B) and, upon operation of the switch, generates selectively one of said time-setting and displaying mode signals.

Figure 2A:
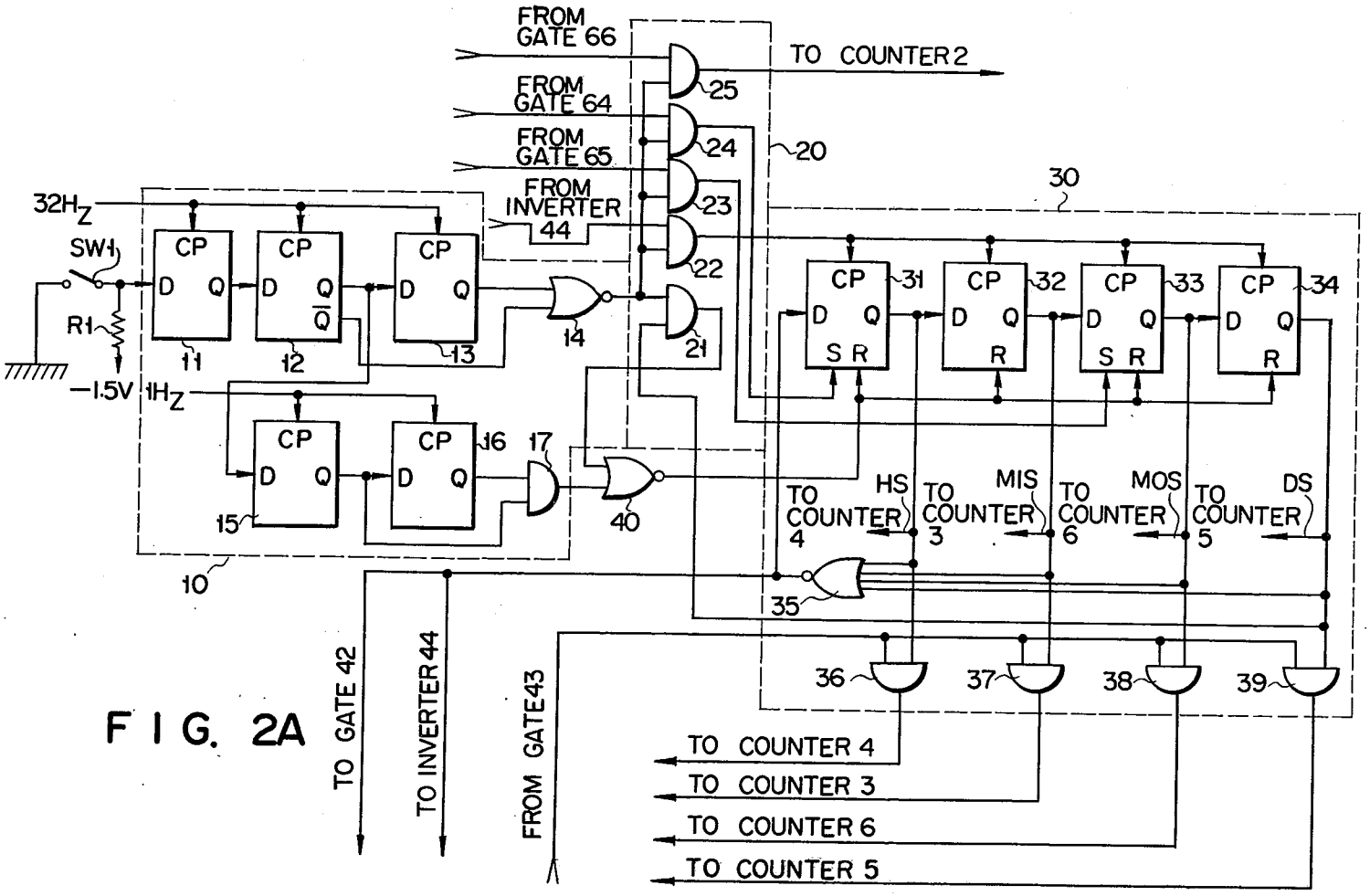
FIGS. 2A and 2B are block circuit diagrams showing in detail the mode control circuit of FIG. 1.

In FIG. 2A, a switch operative condition detecting circuit 10 has cascade connected shift registers 11, 12 and 13 receiving a clock pulse of, for example, 32 Hz at their respective clock terminals CP and a NOR gate 14 whose input terminals are connected to an output terminal $\overline{Q}$ of the shift register 12 and an output terminal Q of the shift register 13. The switch SW1 is grounded at one end and is connected at the other end to a negative power source of, for example, —1.5 volts through a resistor R1 and is connected to an input terminal D of the shift register 11, whereby an electrical signal having a low level or logic "0" level when the switch SW1 is opened and having a high level when the switch SW1 is closed is supplied to the shift register 11. This electrical signal is supplied to the shift registers 12, 13 from the shift register 11 with a small length of delay time, whereby a pulse having a pulse width of about 1/32 second is generated from the NOR gate 14 each time the switch is depressed. The switch operative condition detecting circuit 10 has cascade connected shift registers 15 and 16 receiving a clock pulse of 1 Hz at their respective clock terminals CP and an AND gate 17 connected to respective output terminals Q of the shift registers 15 and 16. To an input terminal D of the shift register 15 is connected an output terminal Q of the shift register 12. Accordingly, during a period by which the length of switch SW1-depressing time exceeds about two seconds, a signal having a high level is generated from the AND gate 17.

A gate circuit 20 has AND gates 21, 22, 23, 24 and 25, respective first input terminals of which are connected to an output terminal of the NOR gate 14. A time-setting mode circuit 30 is composed of cascade connected shift registers 31, 32, 33 and 34 receiving an output signal from the AND gate 22 at their respective clock terminals CP, a NOR gate 35 receiving an output signal from each of the shift registers 31, 32, 33 and 34 and supplying its output signal to an input terminal D of the shift register 31, and AND gates 36, 37, 38 and 39 receiving the output signals from the shift registers 31, 32, 33 and 34 at their respective first input terminals. The shift registers 31 to 34 and the NOR gate 35 forms a ring counter the content of which is shifted by a pulse from the AND gate 22. Output signals from the AND gates 24 and 23 are supplied to set terminals S of the shift registers 31 and 33, respectively. A NOR gate 40 whose input terminals are connected to respective output terminals of the AND gate 17 and the AND gate 21 a second input terminal of which is connected to an output terminal of the shift register 34 supplies its output signal to reset terminals R of the shift registers 31 to 34 when the switch SW1 continues to be depressed for two or more seconds, or when the switch SW1 is depressed during a "date" setting mode period.

Figure 2B:
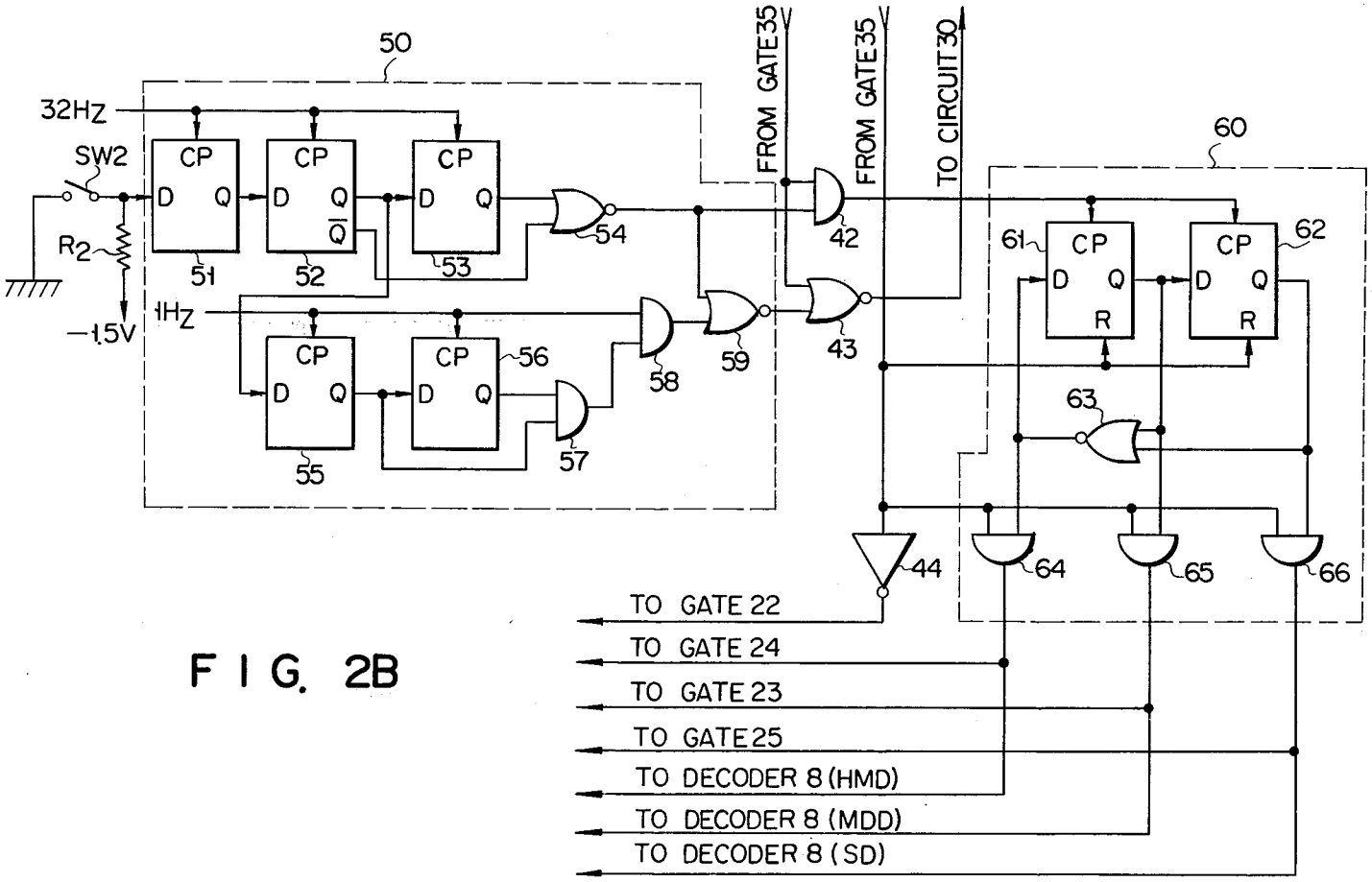

In FIG. 2B, a switch operative condition detecting circuit 50 has cascade connected shift registers 51, 52 and 53 receiving a pulse of, for example, 32 Hz at their respective clock terminals CP and a NOR gate 54 whose input terminal is connected to an output terminal $\overline{Q}$ of the shift register 52 and an output terminal Q of the shift register 53. Similarly to the switch SW1, a switch SW2 is grounded at one end and is connected at the other end to a negative power source of, for example, −1.5 volts through a resistor R2, and supplies a high level signal to an input terminal D of the shift register 51 when depressed. The switch operative condition detecting circuit 50 further includes cascade connected shift registers 55 and 56 receiving a pulse of, for example, 1 Hz at their respective clock terminals CP and an AND gate 57 receiving output signals from the shift registers 55 and 56. The shift register 55 has an input terminal D connected to an output terminal Q of the shift register 52. As in the case of the switch operative condition detecting circuit 10, upon depression of the switch SW2, a pulse is generated from the NOR gate 54 and, during a period by which the length of switch SW2-depressing time exceeds about two seconds, a high level signal is generated from the AND gate 57. An output signal from the AND gate 57 is supplied to an AND gate 58 together with a pulse of 1 Hz. Output signals from the AND gate 58 and the NOR gate 54 are supplied to a NOR gate 59. Namely, where the switch SW2 continues to be depressed for about two or more seconds, a pulse signal of 1 Hz is generated from the NOR gate 59. A NOR gate 43 has input terminals connected to the output terminals of the NOR gates 59 and 35 (FIG. 2A) and an output terminal connected to respective second input terminals of the AND gates 36, 37, 38 and 39 (FIG. 2A).

A time-displaying mode circuit 60 has cascade connected shift registers 61, 62, and a NOR gate 63 having input terminals connected to output terminals Q of the shift registers 61 and 62, respectively, and an output terminal connected to an input terminal D of the shift register 61. To clock terminals CP of the shift registers 61 and 62 is connected an output terminal of an AND gate 42 receiving output signals from the NOR gates 54 and 35 (FIG. 2A). The shift registers 61, 62 and NOR gate 63 form a ring counter the content of which is shifted by an output signal from the AND gate 42. The output terminals of the shift registers 61, 62 and NOR gate 63 are connected to first input terminals of the AND gates 65, 66 and 64, respectively. To second input terminals of the AND gates 64, 65 and 66 and the input terminal of an inverter 44 and reset terminals R of the shift registers 61 and 62 is connected the outut terminal of the NOR gate 35 (FIG. 2A). Output terminals of the inverter 44 and the AND gates 64, 65 and 66 are connected to the AND gates 22, 23 and 25, respectively.

Hereinafter, the operation of the above-mentioned mode control circuit is explained with reference to FIGS. 2A and 2B and the following Table.

Table 1

| Mode | Switch | SW1 | SW2 |
|---|---|---|---|
| Time-displaying mode | Hour-minute | Change-over to the "hour" setting mode in accordance with the ON-OFF operation | Change-over to the "month-date" displaying mode in accordance with the ON-OFF operation |
| | Month-date | Change-over to the "month" setting mode in accordance with the ON-OFF operation | Change-over to the "second" displaying mode in accordance with the ON-OFF operation |
| | Second | Generate "second" resetting signals in accordance with the ON-OFF operation | Change-over to the "hour-minute" displaying mode in accordance with the ON-OFF operation |
| Time-setting mode | Hour | Change-over to the "minute" setting mode in accordance with the ON-OFF operation | Permit a step-advance operation when kept depressed for more than two seconds |
| | Minute | Change-over to the "month" setting mode in accordance with the ON-OFF operation | Permit a step-advance operation when kept depressed for more than two seconds |
| | Month | Change-over to the "date" setting mode in accordance with the ON-OFF operation | Permit a step-advance operation when kept depressed for more than two seconds |
| | | Change-over to the "hour-minute" dis- | Permit a step-advance |

Table 1-continued

| Mode | Switch | SW1 | SW2 |
|---|---|---|---|
| | Date | playing mode in accordance with the ON-OFF operation | operation when kept depressed for more than two seconds |

The above Table 1 shows the change-over condition of the mode in the case where, in the mode control circuit shown in FIGS. 2A and 2B, the switches SW1 and SW2 are operated. As seen from Table 1, when in the "hour-minute" displaying mode the switch SW1 is subject to an ON-OFF operation for a small length of time, for example, for less than about two seconds, the mode is changed over to the "hour" setting mode. During the "hour-minute" displaying mode period, the output signals from the shift registers 31 to 34, 61 and 62 all have a "0" level, and an output signal from the AND gate 64 is supplied as the "hour-minute" display signal HMD to the decoder circuit 8 and simultaneously is supplied to the AND gate 24 to open the same. When, in this condition, the switch SW1 is depressed, an output pulse is generated from the NOR gate 14 and is applied to the set terminal S of the shift register 31 through the AND gate 24. As a result, the shift register 31 generates a signal having a "1" level, which is supplied as an hour setting mode signal to the counter 4, whereby the operation for changing over the mode to the "hour" setting mode is completed. Since, in this condition, the output signal from the NOR gate 35 is maintained at a "0" level, a signal having a "1" level is supplied to the AND gate 22 through the inverter 44 to keep this gate 22 open. When, in this condition, the switch SW1 is depressed, an output pulse from the NOR gate 14 is applied to the clock terminals CP of the shift registers 31 to 34 through the AND gate 22 to shift the content of the shift registers 31 to 34. As a result, an output signal from the shift register 32 has a "1" level and this signal is supplied as the "minute" setting mode signal MIS to the counter 3, whereby the "minute" setting mode is established. When the switch SW1 is next depressed, a "1" level signal is generated from the shift register 33, and is supplied as the "month" setting mode signal MOS to the counter 6. When the switch SW1 is further depressed, a "1" level signal is generated from the register 34 and is supplied as the "date" setting mode signal DS to the counter 5. In this way, through depression or operation of the switch SW1, the time-setting mode is changed over in turn as indicated in Table 1.

During the time-setting mode period, the NOR gate 35 generates a "0" level signal to reset the shift registers 61 and 62, but, since the AND gate 64 is closed by the "0" level output signal from the NOR gate 35, the output signal from the NOR gate 63 is blocked by that AND gate 64. However, when, during the "date" setting mode period, the switch SW1 is depressed, the output signals from the shift registers 31 to 34 all have a "0" level, so that a "1" level output signal is generated from the NOR gate 35 to open the AND gate 64, so that the output signal from the NOR gate 63 is applied to the AND gate 24 and simultaneously is supplied as the "hour-minute" displaying mode signal HMD to the decoder circuit 8. Thus, the "hour-minute" displaying mode is established. When, under this condition, the switch SW2 is depressed, a pulse from the NOR gate 54 is applied to the clock terminals CP of the shift registers 61 and 62 through the AND gate 42 to shift the content of the shift registers 61 and 62 to cause the shift register 61 to generate a "1" level signal. The "1" level signal from the shift register 61 is supplied to the AND gate 23 through the AND gate 65 and simultaneously is supplied as the "month-date" displaying mode signal MDD to the decoder 8, whereby the "month-date" displaying mode is established. When, under this condition, the switch SW2 is depressed, the content of the shift registers 61, 62 is shifted, so that the output signal from the shift register 62 has a "1" level and is supplied to the AND gate 25 through the AND gate 66 and simultaneously is supplied as the "second" displaying mode signal to the decoder 8, whereby the "second" displaying mode is established. When, under this condition, the switch SW2 is depressed, the mode is changed over to the "hour-minute" displaying mode. When, under the "second" displaying mode condition, the switch SW1 is depressed, a pulse from the NOR gate 14 is supplied to the "second" counter 2 through the AND gate 25, thereby to make the "second" display zero.

When, under the "month-date" displaying mode, the switch SW1 is depressed, a pulse from the NOR gate 14 is applied to the set terminal S of the shift register 33 through the AND gate 23. This pulse causes the shift register 33 to generate an output signal having a "1" level. This output signal is supplied as the "month" setting mode signal MOS to the counter 6, whereby the "month" setting mode is established. In this way, according to the invention, where the "hour-minute" displaying mode is desired to be changed over to the "month" setting mode, it is sufficient to simply first depress the switch SW2 once and then depress the switch SW1, for which reason, the mode changing-over is readily carried out.

When the switch SW1 continues to be depressed for about two or more seconds under any time setting mode; a pulse is generated from the AND gate 17, so that the shift registers 31 to 34 are reset by the resulting output signal from the NOR gate 40 which has a "0" level, whereby the "hour-minute" displaying mode is established. When, under the "time" setting mode, the switch SW2 is depressed for about two or more seconds, a 1 Hz pulse signal is generated from the AND gate 58 correspondingly to a period by which the length of switch SW2-depressing time exceeds about two seconds. This pulse is supplied through the NOR gates 59, 43 and then through the AND gate 36, 37, 38 or 39, respectively, to the counter 4, 3, 6 or 5 thereby to step-advance the counter corresponding to the existing time setting mode.

This invention has above been explained by describing the embodiment, but is not limited only to this embodiment.

For instance, the shift registers used in the above embodiment is so designed as to be reset by the "0" level signal, but it is also possible to use a shift register set by the "1" level signal. In this case, it is sufficient to simply use the OR gate in place of the NOR gate and connect the output signal from the NOR gate 35 to the reset terminal of the shift registers 61 and 62 through an inverter.

Figure 3:
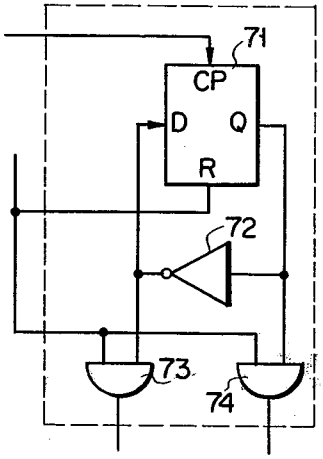
FIG. 3 is a block circuit diagram showing a modification of a time-displaying mode memory circuit used in the mode control circuit of FIG. 1.

In the case of requiring only two types of time-displaying modes, the time-displaying mode circuit 60 is modified as shown in FIG. 3. The time-displaying mode circuit shown in FIG. 3 includes a shift register 71 and an inverter 72 connected to an output terminal Q of the shift register 71, an output terminal of said inverter 72 being connected to the respective input terminals of an AND gate 73 and the shift register 71. The output terminal Q of the shift register 71 is connected also to an input terminal of an AND gate 74. The AND gates 73 and 74 receive an output signal from the NOR gate 35 (FIG. 2A) at their respective remaining input terminals and a clock terminal CP of the shift register 71 is connected to the output terminal of the AND gate 42.

What we claim is:

1. A time-setting and displaying mode control circuit for an electronic timepiece comprising a first and a second switch, a first-switch operative condition detecting circuit for generating a signal upon operation of said first switch, a second-switch operative condition detecting circuit for generating a signal upon operation of said second switch, a first ring counter having a first shift register circuit composed of cascade connected shift registers and a first logic circuit whose input terminals are connected to output terminals of said shift registers, respectively, and whose output terminal is connected to the input terminal of the first stage shift register of said first shift register circuit, and adapted to generate a signal corresponding to one of time-setting modes from output terminals of said shift registers of said first shift register circuit, a second ring counter including a second shift register circuit having at least one shift register, a second logic circuit having input terminals connected to said output terminal of said first logic circuit, an input terminal of said second shift register circuit, and an output terminal of said at least one shift register of said second shift register circuit, and controlled by an output signal from said first logic circuit to generate a signal corresponding to one of time-displaying modes, a first mode control circuit connected to said first-switch operative condition detecting circuit and adapted to shift, upon operation of said first switch under a time-setting mode, the content of said first ring counter and to change-over, upon operation of said first switch under either one of first and second specified time displaying modes, said time displaying mode to a corresponding one of first and second specified time setting modes by setting a specified shift register of said first shift register circuit, and a second mode control circuit connected to said second-switch operative condition detecting circuit and said first logic circuit and adapted to generate an output signal to shift the content of said second ring counter each time said second switch is operated during a time-displaying mode period.

2. A time-setting and displaying mode control circuit according to claim 1, wherein said second logic circuit includes a plurality of AND circuits each having a first input terminal connected to said output terminal of said first logic circuit and a second input terminal connected to an input terminal of said second shift register circuit and the output terminal of said at least one shift register of said second shift register circuit; and said first mode control circuit includes AND circuits having first input terminals connected to an output terminal of said first-switch operative condition detecting circuit, second input terminals respectively connected to output terminals of specified two AND circuits of said second logic circuit for receiving an output signal from said second ring counter and output terminals respectively connected to set terminals of specified two shift registers of said first shift register circuit, and an AND circuit adapted to receive a logical sum signal of output signals from all of said shift registers of said first shift register circuit and an output signal from said first-switch operative condition detecting circuit and having an output terminal connected to a clock terminal of each shift register of said first shift register circuit.

3. A time-setting and displaying mode control circuit according to claim 2, wherein said second ring counter is composed of one shift register and an inverter for inverting an output signal of the shift register to supply an output signal to an input terminal of said shift register.

4. A time-setting and displaying mode control circuit according to claim 2, wherein said second ring counter is composed of cascade connected shift registers and a NOR circuit having input terminals respectively connected to output terminals of said cascade connected shift registers of said second ring counter and an output terminal connected to an input terminal of an initial stage shift register of said cascade connected shift register of said second ring counter.

5. A time-setting and displaying mode control circuit according to claim 2, which further comprises a reset circuit coupled to said first switch to generate an output signal during a period by which the length of time of depressing said first switch exceeds a specified value, thereby to reset each shift register of said first shift register circuit.

6. A time-setting and displaying mode control circuit according to claim 1, which further comprises a reset circuit coupled to said first switch to generate an output signal during a period by which the length of time of depressing said first switch exceeds a specified value, thereby to reset each shift register of said first shift register circuit.

7. A time-setting and displaying mode control circuit according to claim 1, which further comprises a pulse generator connected to said second switch to generate a pulse signal during a period by which the length of time of depressing said second switch exceeds a specified value, and AND circuits having first input terminals connected to said output terminals of said shift registers of said first shift register circuit, respectively, and second input terminals connected to an output terminal of said pulse generator.

8. A time-setting and displaying mode control circuit according to claim 1, wherein said second mode control circuit is composed of an AND circuit having an output terminal connected to a clock terminal of said at least one shift register of said second shift register circuit.

9. A time-setting and displaying mode control circuit according to claim 1, wherein said first logic circuit is composed of a NOR circuit.

10. A time-setting and displaying mode control circuit according to claim 1, wherein said first-switch operative condition detecting circuit includes three cascade connected shift registers an input terminal of the first stage shift register of which is connected to said first switch, and a first NOR gate for receiving a signal prepared by inverting an output signal from the second stage shift register of said three cascade connected shift registers and an output signal from the final stage shift register of said three cascade connected shift registers;

said first mode control circuit has five AND gates having, respectively, first input terminals connected to an output terminal of said first NOR gate; said first shift register circuit of said first ring counter is composed of four shift registers; said first logic circuit is composed of a second NOR gate; said second-switch operative condition detecting circuit includes three cascade connected shift registers an input terminal of the first stage shift register of which is connected to said second switch, and a third NOR gate for receiving a signal prepared by inverting an output signal from the second stage shift register of said three cascade connected shift registers of said second-switch operative condition detecting circuit and an output signal from the final stage shift register of said three cascade connected shift registers of said second-switch operative condition detecting circuit; said second ring counter includes two cascade connected shift registers and a fourth NOR gate having an input terminal connected to respective output terminals of said two cascade connected shift registers and an output terminal connected to an input terminal of said second shift register circuit; said second logic circuit is composed of three AND gates having respectively first input terminals connected to output terminals of said second shift register circuit and said output terminal of said fourth NOR gate and second input terminals connected to an output terminals of said second NOR gate; said second mode control circuit is composed of an AND gate having input terminsls respectively connected to the output terminals of said second and third NOR gates and an output terminal connected to clock terminals of the shift registers of said second shift register circuit; said output terminal of said second NOR gate is connected to a second input terminal of a first one of said five AND gates of said first mode control circuit through an inverter, an output terminal of said first one of said five AND gates being connected to clock terminals of the shift registers of said first shift register circuit; an output terminal of that first AND gate of said second logic circuit which receives an output signal from said fourth NOR gate is connected to a second input terminal of a second one of said five AND gates of said first mode control circuit, an output terminal of said second one of said five AND gates being connected to a set terminal of the first stage shift register of said second shift register circuit; an output terminal of a second AND gate of said second logic circuit is connected to a second input terminal of a third one of said five AND gates of said first mode control circuit, an output terminal of said third of said five AND gates being connected to a set terminal of the third stage shift register of said first shift register circuit; an output terminal of a third AND gate of said second logic circuit is connected to a second input terminal of a fourth one of said five AND gates of said first mode control circuit, said fourth one of said five AND gates being adapted to generate a "second" resetting signal when enabled; and an output terminal of a final stage shift register of said first shift register circuit is connected to a second input terminal of a fifth one of said five AND gates of said first mode control circuit, said fifth one of said AND gates being adapted to reset each of said shift registers of said second shift register circuit when enabled.

11. A time-setting and displaying mode control circuit according to claim 10, which further comprises a reset circuit including an first stage shift register having an input terminal connected to an output terminal of the second stage shift register of said first-switch operative condition detecting circuit, a second stage shift register cascade connected to said first stage shift register of said reset circuit, and an AND gate having input terminals respectively connected to respective output terminals of said first and second stage shift registers of said reset circuit and an output terminal connected to a reset terminal of each shift register of said first shift register circuit, whereby to generate an output signal during a period by which the length of time of depressing said first switch exceeds a specified value to reset each shift register of said first shift register circuit.

12. A time-setting and displaying mode control circuit according to claim 10, which further comprises a pulse generator having an first stage shift register connected to an output terminal of a second stage shift register of said second-switch operative condition detecting circuit, a second stage shift register cascade connected to said initial stage shift register of said pulse generator, a sixth AND gate having input terminals respectively connected to output terminals of said first and second stage shift registers of said pulse generator, a seventh AND gate for receiving an output signal from said sixth AND gate and a pulse signal having a specified frequency, and a fifth NOR gate for receiving respective output signals from said seventh AND gate and said third NOR gate of said second-switch operative condition detecting circuit, whereby to generate a pulse signal having said specified frequency during a period by which the length of time of depressing said second switch exceeds a specified value; a sixth NOR gate for receiving respective output signals from said pulse generator and said second NOR gate; and four AND gates having respectively first input terminals connected to an output terminal of said sixth NOR gate and second input terminals connected to the output terminals of said shift registers of said first shift register circuit.

13. A time-setting and displaying mode control circuit according to claim 5 in which said reset circuit comprises two serially connected shift registers and an AND gate whose input terminals are connected to the output terminals of said two serially connected shift registers, respectively, and whose output terminal is connected to the reset terminal of each shift register of said first shift register circuit, wherein the input terminal of the first stage of said two serially connected shift registers is coupled to said first switch and said AND gate produces an output signal when said first switch is kept depressed longer than a specified period of time.

* * * * *